US007374395B2

(12) United States Patent
Durocher et al.

(10) Patent No.: US 7,374,395 B2
(45) Date of Patent: May 20, 2008

(54) TURBINE SHROUD SEGMENT FEATHER SEAL LOCATED IN RADIAL SHROUD LEGS

(75) Inventors: Eric Durocher, Verchères (CA); Martin Clermont, Montreal (CA)

(73) Assignee: Pratt & Whitney Canada Corp., Longueuil (CA)

( * ) Notice: Subject to any disclaimer, the term of this patent is extended or adjusted under 35 U.S.C. 154(b) by 374 days.

(21) Appl. No.: 11/183,922

(22) Filed: Jul. 19, 2005

(65) Prior Publication Data

US 2007/0020087 A1 Jan. 25, 2007

(51) Int. Cl.
*F04D 29/38* (2006.01)

(52) U.S. Cl. ..... 415/115; 416/191

(58) Field of Classification Search ..... 415/115, 415/116, 182.1, 108, 196, 173.1; 416/191, 416/93 R, 96 R, 97 R
See application file for complete search history.

(56) References Cited

U.S. PATENT DOCUMENTS 4,642,024 A 2/1987 Weidner
4,767,260 A * 8/1988 Clevenger et al. ..... 415/115
5,188,506 A 2/1993 Creevy et al.
5,273,396 A 12/1993 Albrecht et al.
5,423,659 A 6/1995 Thompson
5,553,999 A 9/1996 Proctor et al.
5,762,472 A * 6/1998 Pizzi et al. ..... 415/135
5,971,703 A 10/1999 Bouchard
5,988,975 A 11/1999 Pizzi
5,993,150 A 11/1999 Liotta et al.
6,179,557 B1 1/2001 Dodd et al.
6,402,466 B1 6/2002 Burdgick et al.
6,530,744 B2 3/2003 Liotta et al.
6,821,085 B2 11/2004 Darkins, Jr. et al.
6,893,214 B2 5/2005 Alford et al.

OTHER PUBLICATIONS

International Search Report dated Nov. 14, 2006 for corresponding PCT International Application No. PCT/CA2006/001183.

* cited by examiner

*Primary Examiner*—Edward K. Look
*Assistant Examiner*—Dwayne J White
(74) *Attorney, Agent, or Firm*—Ogilvy Renault LLP

(57) ABSTRACT

A turbine shroud assembly is configured to adequately adjust a distribution of cooling air flow such that air leakage between radial shroud legs of adjacent shroud segments is minimized, while permitting cooling air to leak between platforms of adjacent shroud segments in order to cool sides of the platforms thereof.

17 Claims, 4 Drawing Sheets

TURBINE SHROUD SEGMENT FEATHER SEAL LOCATED IN RADIAL SHROUD LEGS

TECHNICAL FIELD

The present invention relates generally to gas turbine engines and more particularly to turbine shroud cooling.

BACKGROUND OF THE ART

A gas turbine shroud assembly usually includes a plurality of shroud segments disposed circumferentially one adjacent to another, to form a shroud ring circling a turbine rotor. Being exposed to very hot gasses, the turbine shroud assembly usually needs to be cooled. Since flowing coolant through the shroud diminishes overall engine performance, it is typically desirable to minimize cooling flow consumption without degrading shroud segment durability. Heretofore, efforts have been made to prevent undesirable cooling flow leakage and to provide adequate distribution of cooling flow to segment parts having elevated temperatures such as the platforms of the shroud segments. Nevertheless, in conventional cooling arrangements in turbine shroud assemblies, according to thermal analysis, relatively hot spots can occur, for example on opposite side edges of the segment platform, which adversely affect shroud segment durability.

Accordingly, there is a need to provide an improved turbine shroud assembly which addresses these and other limitations of the prior art.

SUMMARY OF THE INVENTION

It is therefore an object of the present invention to provide a turbine shroud assembly to be adequately cooled.

One aspect of the present invention therefore provides a turbine shroud assembly of a gas turbine engine which comprises a plurality of shroud segments disposed circumferentially one adjacent to another, an annular support structure supporting the shroud segments together within an engine casing, and seals provided between adjacent shroud segments. Each of the shroud segments includes a platform which collectively with platforms of adjacent shroud segments forms a shroud ring, and also includes front and rear legs integrated with the platform and extending radially and outwardly therefrom for connection with the annular support structure, thereby supporting the platform radially and inwardly spaced apart from the annular support structure to define an annular cavity between the front and rear legs. The seals are disposed between the radial legs of adjacent shroud segments while radial air passages are provided between platforms of the adjacent shroud segments to permit cooling of sides of the platforms of the respective shroud segments.

Another aspect of the present invention provides a cooling arrangement in a turbine shroud assembly of a gas turbine engine in which the turbine shroud assembly has a plurality of shroud segments, and in which the shroud segments include platforms disposed circumferentially adjacent one to another collectively to form a shroud ring. Front and rear legs extend radially from an outer surface of the platforms, thereby defining a cavity therebetween. The cooling arrangement comprises a first means for substantially preventing cooling air within the cavity from leakage between the front legs and between the rear legs of adjacent shroud segments and a second means for permitting use of cooling air within the cavity to cool edges between an inner surface and respective opposite sides of the platforms of the respective shroud segments.

A further aspect of the present invention provides a method for cooling shroud segments of a turbine shroud assembly of a gas turbine engine, comprising steps of (a) continuously introducing cooling air into a cavity defined radially between radial front legs and radial rear legs of the shroud segments and axially between platforms of the shroud segments and an annular support structure; (b) substantially preventing air leakage between the radial front legs and between the radial rear legs of the shroud segments for maintaining a predetermined pressure of the cooling air within the cavity; and (c) continuously directing the cooling air from the cavity through radial passages between platforms of adjacent shroud segments into a gas path defined by the platforms of the shroud segments, thereby cooling sides of the respective shroud segments.

These and other features of the present invention will be better understood with reference to preferred embodiments described hereinafter.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
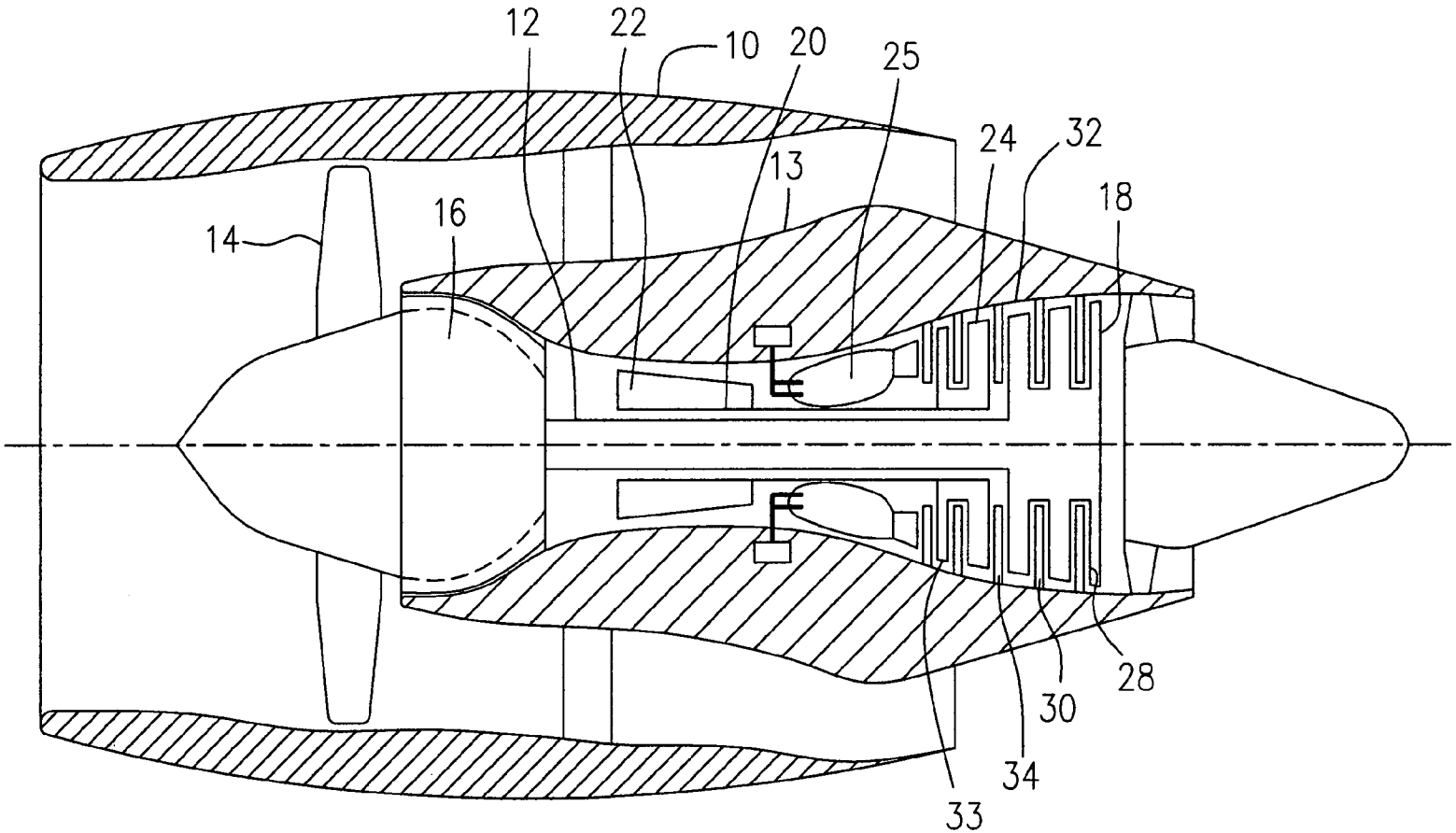
FIG. 1 is a schematic cross-sectional view of a gas turbine engine.
Figure 2:
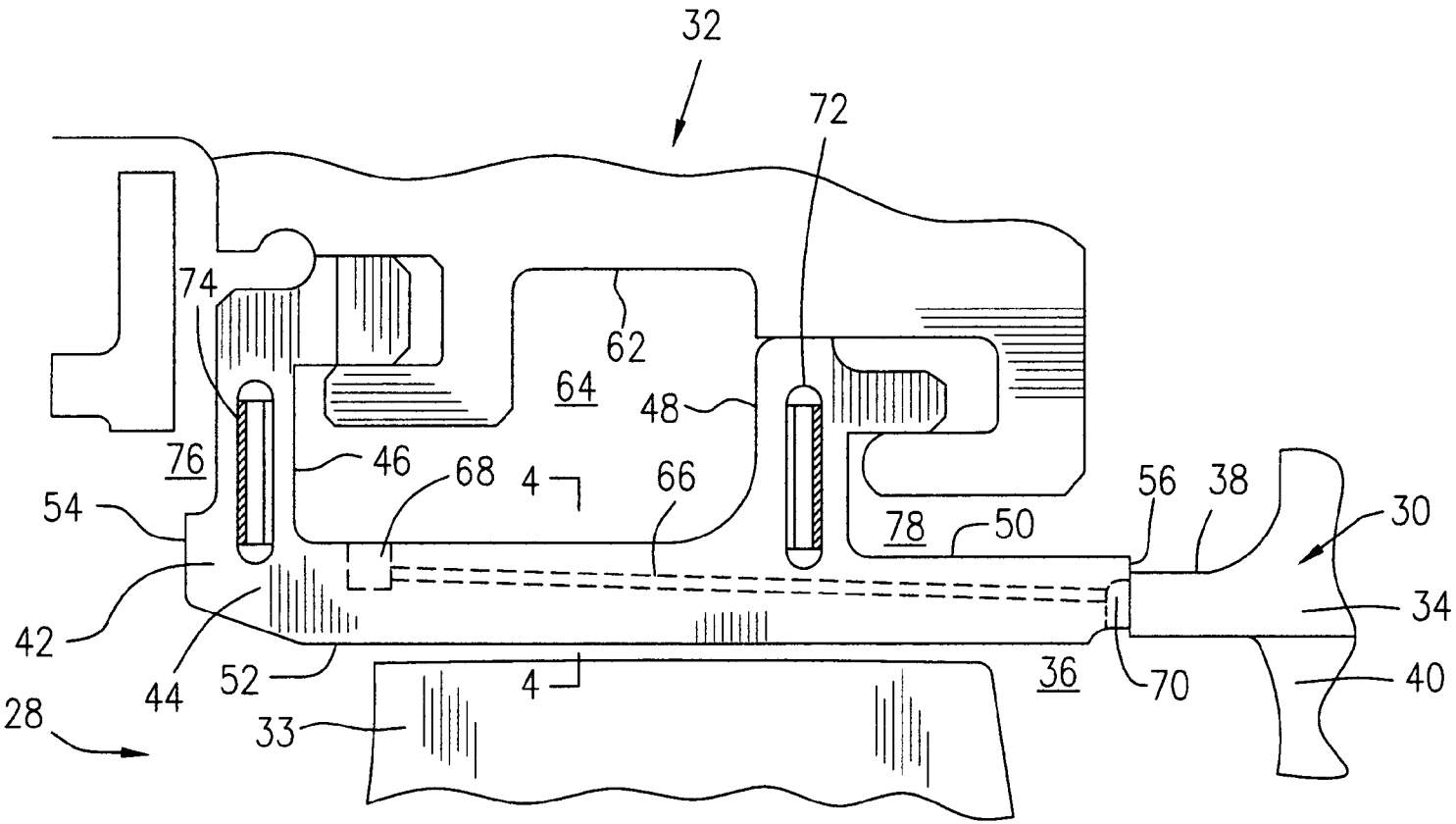
FIG. 2 is an axial cross-sectional view of a turbine shroud assembly used in the gas turbine engine of FIG. 1, in accordance with one embodiment of the present invention.
Figure 3:
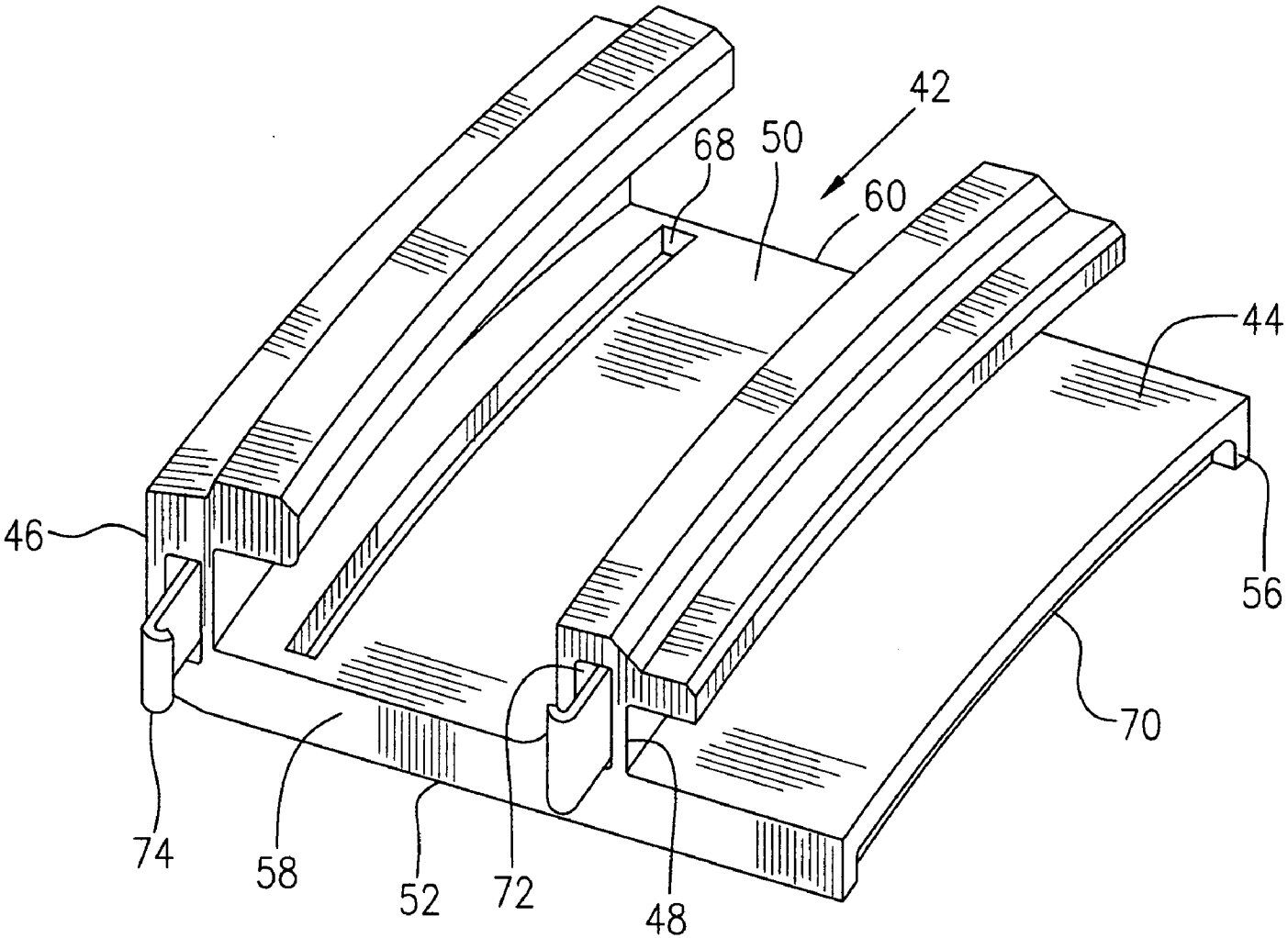
FIG. 3 is a perspective view of a shroud segment used in the turbine shroud assembly of FIG. 2.
Figure 4:
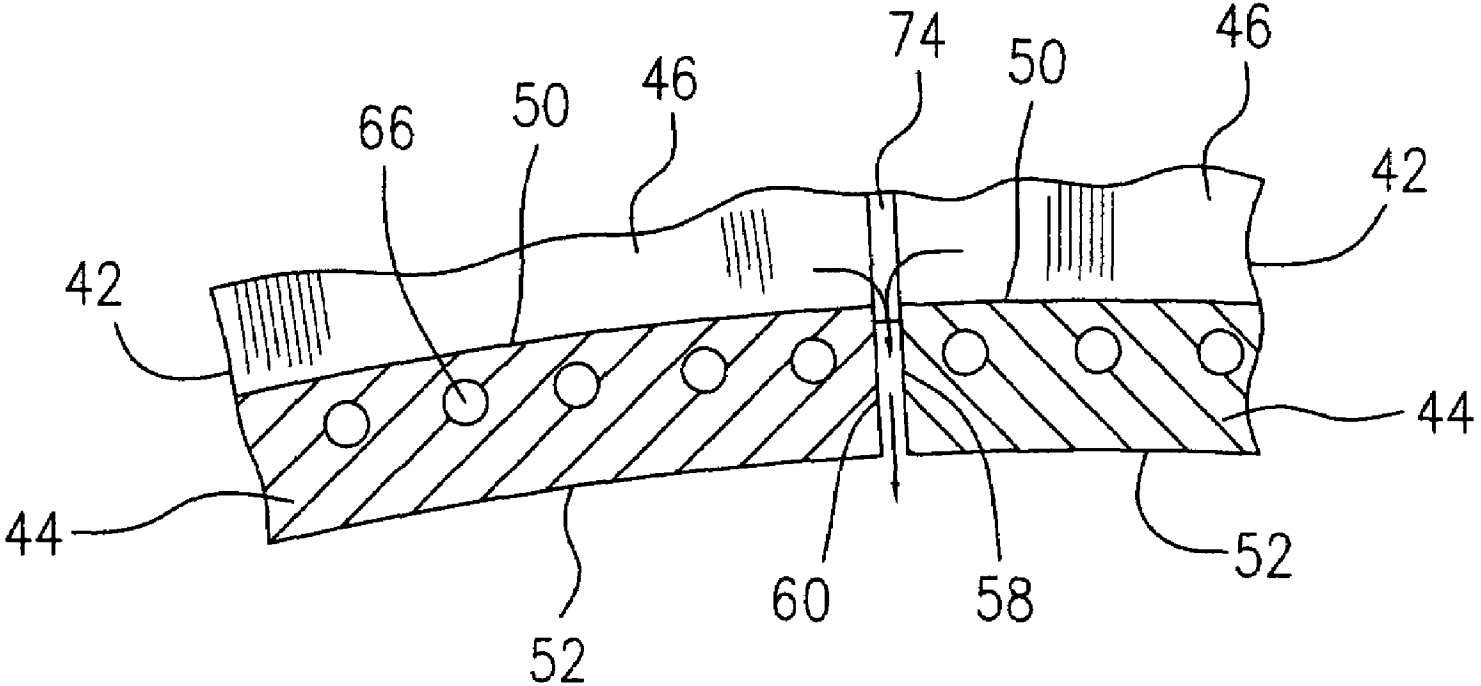
FIG. 4 is a partial cross-sectional view of the shroud assembly taken along line 4-4 in FIG. 2, showing the radial passages for cooling air to pass through, formed by the clearance between mating sides of the platforms of the adjacent shroud segments.

Referring to FIG. 1, a turbofan gas turbine engine incorporates an embodiment of the present invention, presented as an example of the application of the present invention, and includes a housing or a nacelle 10, a core casing 13, a low pressure spool assembly seen generally at 12 which includes a fan 14, low pressure compressor 16 and low pressure turbine 18, and a high pressure spool assembly seen generally at 20 which includes a high pressure compressor 22 and a high pressure turbine 24. There is provided a burner 25 for generating combustion gases. The low pressure turbine 18 and high pressure turbine 24 include a plurality of rotor stages 28 and stator vane stages 30.

Referring to FIGS. 1-4, each of the rotor stages 28 has a plurality of rotor blades 33 encircled by a turbine shroud assembly 32 and each of the stator vane stages 30 includes a stator vane assembly 34 which is positioned upstream and/or downstream of a rotor stage 31, for directing combustion gases into or out of an annular gas path 36 within a corresponding turbine shroud assembly 32, and through the corresponding rotor stage 31.

The stator vane assembly 34, for example a first stage of a low pressure turbine (LPT) vane assembly, is disposed, for example, downstream of the shroud assembly 32 of one rotor stage 28, and includes, for example a plurality of stator vane segments (not indicated) joined one to another in a circumferential direction to form a turbine vane outer shroud 38 which comprises a plurality of axial stator vanes 40 (only a portion of one is shown) which divide a downstream section of the annular gas path 36 relative to the rotor stage 28, into sectoral gas passages for directing combustion gas flow out of the rotor stage 28.

The shroud assembly 32 in the rotor stage 28 includes a plurality of shroud segments 42 (only one shown) each of which includes a platform 44 having front and rear radial legs 46, 48 with respective hooks (not indicated). The shroud segments 42 are joined one to another in a circumferential direction and thereby form the shroud assembly 32.

The platform 44 of each shroud segment 42 has outer and inner surfaces 50, 52 and is defined axially between leading and trailing ends 54, 56, and circumferentially between opposite sides 58, 60 thereof. The platforms 44 of the segments collectively form a turbine shroud ring (not indicated) which encircles the rotor blades 33 and in combination with the rotor stage 28, defines a section of the annular gas path 36. The turbine shroud ring is disposed immediately upstream of and abuts the turbine vane outer shroud 38, to thereby form a portion of an outer wall (not indicated) of the annular gas path 36.

The front and rear radial legs 46, 48 are axially spaced apart and integrally extend from the outer surface 50 radially and outwardly such that the hooks of the front and rear radial legs 46, 48 are conventionally connected with an annular shroud support structure 62 which is formed with a plurality of shroud support segments (not indicated) and is in turn supported within the core casing 13. An annular middle cavity 64 is thus defined axially between the front and rear legs 46, 48 and radially between the platforms 44 of the shroud segments 42 and the annular shroud support structure 62. The annular middle cavity is in fluid communication with a cooling air source, for example bleed air from the low or high pressure compressors 16, 22 and thus the cooling air under pressure is introduced into and accommodated within the annular middle cavity 64.

The platform 44 of each shroud segment 42 preferably includes an air cooling passage, for example a plurality of holes 66 extending axially within the platform 44 for directing cooling air therethrough for transpiration cooling of the platform 44. For convenience of the hole drilling, a groove 68 extending in a circumferential direction with opposite ends closed is provided, for example, on the outer surface 50 of the platform 44 such that holes 66 can be drilled from the trailing end 56 of the platform straightly and axially towards and terminate at the groove 68. Thus, the groove 68 forms a common inlet of the holes 66 for intake of cooling air accommodated within the middle cavity 64. However, other types of outlets can be made to achieve the convenience of the hole drilling process. It is also preferable to provide one or more outlets of the holes 66 in order to adequately discharge the cooling air from the holes 66 and reduce the contact surface of the trailing end 56 of the platform 44 of the shroud segments 42 with respect to the turbine vane outer shroud 38. For example, an elongate recess 70 is provided in the trailing end 56 of the platform 44 with an opening on the inner surface 52 of the platform 44, thereby forming a common outlet of the holes 66 to discharge the cooling air, for example to the gas path 36. Other types of outlets can be used for adequately discharging the cooling air from the holes 66.

The groove 68 is in fluid communication with the middle cavity 64 and thus cooling air introduced into the middle cavity 64 is directed into and through the axial holes 66 for effectively cooling the platform 44 of the shroud segments 42, and is then discharged through the elongate recess 70 at the trailing end 56 of the platform 42 to further cool a downstream engine part such as the turbine vane outer shroud 38, before entering the gas path 36.

The groove 68 which functions as the common inlet of the holes 66 is preferably located close to the front leg 46 such that the holes 66 extend through a major section of the entire axial length of the platform 44 of the shroud segment 42, thereby efficiently cooling the platform 44 of the shroud segment 42.

It is desirable to provide adequate seals between adjacent shroud segments 42 to prevent cooling air within the middle cavity 64 from leakage in order to maintain the cooling air pressure in the middle cavity 64 at a predetermined level. Therefore, seals are provided between radial front legs 46 and between rear legs 48 of adjacent shroud segments 42. In this embodiment of the present invention, a cavity, preferably a radial slot 72 is defined in opposite sides of the respective front and rear legs 46, 48. A pair of the slots 72 defined in mating sides of adjacent front legs 46 or adjacent rear legs 48, in combination accommodate one seal. For example, a feather seal 74 is provided and each slot 72 receives a portion of the feather seal 74. The feather seal 74 is well known in the prior art and will not be described herein in detail. In brief, the feather seal 74 includes a thin metal band having a generally rectangular cross-section loosely received within the combined cavity formed with the pair of slots 72. Therefore, under the pressure differential between the air pressure in the middle cavity 64, and the air pressure in an front cavity 76 or a rear cavity 78, the feather seal 74 is pressed axially forwardly (in the slot 72 defined in the front legs 46), or axially rearwardly (in the slots 72 defined in the rear legs 48) to abut corresponding side walls of the respective slots 72, thereby substantially blocking axial passages defined by the clearance between mating sides of the adjacent front legs 46 or adjacent rear legs 48. Alternatively, any other type of thin, flexible sheet metal seals can be used for this purpose.

Thermal analysis shows that transpiration cooling of the platform 44 provided by directing cooling air through the axial holes 66 through the platform 44 is effective for most of the area of the platform 44, but is less effective for cooling the area close to the opposite sides 58, 60 thereof, particularly when radial seals are provided between mating sides of adjacent platforms 44, which are widely used in the prior art to control the pressure loss of the cooling air within the middle cavity 64. In accordance with this embodiment of the present invention, clearance is provided between mating sides 58, 60 of the adjacent platforms 44 (see FIG. 4) to form radial passages to permit cooling air within the middle cavity 64 to pass radially and downwardly therethrough into the gas path 36 (as indicated by the arrows in FIG. 4), thereby absorbing heat from the mating sides 58, 60 of the adjacent platforms 44, and resulting in effective cooling particularly on the edges joining the inner surface 52 and the respective sides 58, 60 of the platforms 44 of shroud segments 42.

The present invention adequately adjusts the distribution of cooling air flow to minimize undesirable air leakage in the shroud assembly while effectively cooling the sides of platforms of shroud segments to eliminate relatively hot spots on the platforms near the sides thereof, thereby improving shroud segment durability.

The above description is meant to be exemplary only, and one skilled in the art will recognize that changes may be made to the embodiments described without departure from the scope of the invention disclosed. For example, transpiration cooling of the platforms of shroud segments described in the above embodiment can be otherwise arranged, such as by directing cooling air flows to impinge the outer surface of the platforms for cooling the platforms of the shroud segments. As an alternative to attached seals between the radial shroud legs, any mating configurations of the adjacent radial shroud legs which function as seals to prevent air leakage between the adjacent radial shroud legs can be used in other embodiments of the present invention. Still other modifications which fall within the scope of the present invention will be apparent to those skilled in the art, in light of a review of this disclosure, and such modifications are intended to fall within the appended claims.

The invention claimed is:

1. A turbine shroud assembly of a gas turbine engine comprising a plurality of shroud segments disposed circumferentially one adjacent to another, an annular support structure supporting the shroud segments together within an engine casing, and seals provided between adjacent shroud segments, each of the shroud segments including a platform collectively with platforms of adjacent shroud segments forming a shroud ring, and also including front and rear legs integrated with the platform and extending radially and outwardly therefrom for connection with the annular support structure, thereby supporting the platform radially and inwardly spaced apart from the annular support structure to define an annular cavity between the front and rear legs, the seals being disposed between the radial legs of adjacent shroud segments while radial air passages are defined substantially by clearances between mating side surfaces of adjacent platforms to permit cooling of substantially an entire axial length of sides of the platforms of the respective shroud segments.

2. The turbine shroud assembly as claimed in claim 1 wherein the seals comprise feather seals disposed between each pair of adjacent front legs and between each pair of adjacent rear legs.

3. The turbine shroud assembly as claimed in claim 2 wherein each of the shroud segments comprises radial slots defined in opposite sides of the respective front and rear legs thereof, each for receiving a portion of one feather seal.

4. The turbine shroud assembly as claimed in claim 1 wherein each of the shroud segments comprises a cooling passage extending within and through the platform and having at least one inlet thereof defined on an outer surface between the front and rear legs.

5. The turbine shroud assembly as claimed in claim 4 wherein the cooling passage comprises at least one outlet defined in a trailing end of the platform.

6. A cooling arrangement in a turbine shroud assembly of a gas turbine engine, the turbine shroud assembly having a plurality of shroud segments, the shroud segments including platforms disposed circumferentially adjacent one to another collectively to form a shroud ring, and including front and rear legs extending radially from an outer surface of the platforms thereby defining a cavity therebetween, the cooling arrangement comprising a first means for substantially preventing cooling air within the cavity from leakage between the front legs and between the rear legs of adjacent shroud segments and a second means for permitting use of cooling air within the cavity to cool substantially entire axial edges joining an inner surface and respective opposite sides of the platforms of the respective shroud segments.

7. The cooling arrangement as claimed in claim 6 further comprising a third means for transpiration cooling of the platforms of the shroud segments.

8. The cooling arrangement as claimed in claim 7 wherein the third means comprises a plurality of axial passages extending through the platform of each shroud segment, the axial passages being in fluid communication with the annular cavity between the front and rear legs for intake of the cooling air therein and for discharging same at a trailing end of the platform.

9. The cooling arrangement as claimed in claim 6 wherein the first means comprises a plurality of radially extending feather seals, disposed to substantially block an axial passage between adjacent front legs and between adjacent rear legs, respectively.

10. The cooling arrangement as claimed in claim 9 wherein each of the shroud segments comprises a cavity in opposite sides of the respective front and rear legs, each pair of the cavities defined in mating sides of adjacent legs, in combination accommodating one of the feather seals.

11. The cooling arrangement as claimed in claim 6 wherein the second means comprises a clearance between mating sides of each pair of adjacent shroud segments.

12. A method for cooling shroud segments of a turbine shroud assembly of a gas turbine engine, comprising steps of:

(a) continuously introducing cooling air into a cavity defined axially between radial front legs and radial rear legs of the shroud segments and radially between platforms of the shroud segments and an annular support structure;

(b) substantially preventing air leakage between the radial front legs and between the radial rear legs of the shroud segments for maintaining a predetermined pressure of the cooling air within the cavity; and (c) cooling substantially entire axial edges joining an inner surface and respective opposite sides of the platforms by continuously directing the cooling air from the cavity through radial passages between platforms of adjacent shroud segments into a gas path defined by the platforms of the shroud segments.

13. The method as claimed in claim 12 comprising a step of (d) continuously directing the cooling air from the cavity through a passage extending within and through the individual shroud segments for transpiration cooling of the platforms of the shroud segments.

14. The method as claimed in claim 13 wherein step (d) is practiced by use of at least one inlet of the passage defined on an outer surface and positioned between the front and rear legs of the individual shroud segments for intake of the cooling air.

15. The method as claimed in claim 14 wherein step (d) is practiced by use of at least one outlet of the passage defined in a trailing end of the platform of the individual shroud segments for discharging the cooling air from the passage to cool a part of the engine before entering into the gas path.

16. The method as claimed in claim 12 wherein step (b) is practiced by use of feather seals provided between the radial front legs and between the radial rear legs of the shroud segments.

17. The method as claimed in claim 12 wherein step (e) is practiced by use of clearances between mating sides of adjacent platforms to form the radial passages.

* * * * *

UNITED STATES PATENT AND TRADEMARK OFFICE

CERTIFICATE OF CORRECTION

PATENT NO. : 7,374,395 B2
APPLICATION NO. : 11/183922
DATED : May 20, 2008
INVENTOR(S) : Eric Durocher and Martin Clermont It is certified that error appears in the above-identified patent and that said Letters Patent is hereby corrected as shown below:

In the claim:

claim 17, column 6, line 60, delete "(e)" insert --(c)--

Signed and Sealed this

Second Day of September, 2008

JON W. DUDAS
*Director of the United States Patent and Trademark Office*